US012202586B2

(12) United States Patent
Wang et al.

(10) Patent No.: US 12,202,586 B2
(45) Date of Patent: Jan. 21, 2025

(54) STEAM-POWERED OUTBOARD CONFORMAL COOLING SYSTEM

(71) Applicant: WUHAN 2ND SHIP DESIGN AND RESEARCH INSTITUTE, Hubei (CN)

(72) Inventors: Wei Wang, Hubei (CN); Zhiqiang Qiu, Hubei (CN); Zhiwu Ke, Hubei (CN); Xingsheng Lao, Hubei (CN); Yong Li, Hubei (CN); Bangming Li, Hubei (CN); Zhiguo Wei, Hubei (CN); Yong Liu, Hubei (CN); Chunhui Dai, Hubei (CN); Shaodan Li, Hubei (CN)

(73) Assignee: WUHAN 2ND SHIP DESIGN AND RESEARCH INSTITUTE, Hubei (CN)

( * ) Notice: Subject to any disclaimer, the term of this patent is extended or adjusted under 35 U.S.C. 154(b) by 458 days.

(21) Appl. No.: 17/767,912

(22) PCT Filed: Jan. 22, 2021

(86) PCT No.: PCT/CN2021/073229
§ 371 (c)(1),
(2) Date: Apr. 10, 2022

(87) PCT Pub. No.: WO2022/088530
PCT Pub. Date: May 5, 2022

(65) Prior Publication Data

US 2023/0159148 A1 May 25, 2023

(30) Foreign Application Priority Data

Oct. 28, 2020 (CN) ..... 202011174103.1

(51) Int. Cl.
*B63H 20/28* (2006.01)
*F28D 7/16* (2006.01)
*F28F 9/02* (2006.01)

(52) U.S. Cl.
CPC ..... *B63H 20/285* (2013.01); *F28D 7/16* (2013.01); *F28F 9/02* (2013.01)

(58) Field of Classification Search
CPC ..... B63H 20/285; F28D 7/16; F28F 9/02
See application file for complete search history.

(56) References Cited

FOREIGN PATENT DOCUMENTS

| | | | | |
|---|---|---|---|---|
| CN | 201633913 U | * | 11/2010 | |
| CN | 106782697 A | * | 5/2017 | |
| EP | 1584803 A1 | * | 10/2005 | ..... F01N 13/004 |

* cited by examiner

*Primary Examiner* — Stephen P Avila

(57) ABSTRACT

A steam-powered outboard conformal cooling system includes a steam turbine, a cooler and a conformal heat exchanger. The conformal heat exchanger includes a casing, a lower cap, an upper cap and multiple heat exchange tubes. The casing includes an outer shell plate provided outside a hull plate, the outer shell plate and the hull plate define a seawater heat exchange chamber. A first end of each of the heat exchange tubes is communicated with a cooling water intake chamber, a second end of the each of the heat exchange tubes is communicated with a cooling water discharge chamber, the cooling water intake chamber is communicated with the cooler through a water intake pipe, the cooling water discharge chamber is communicated with the cooler through a water discharge pipe.

18 Claims, 3 Drawing Sheets

STEAM-POWERED OUTBOARD CONFORMAL COOLING SYSTEM

CROSS REFERENCE OF RELATED APPLICATION

This is a U.S. National Stage under 35 U.S.C 371 of the International Application PCT/CN2021/073229, filed Jan. 22, 2021, which claims priority under 35 U.S.C. 119 (a-d) to CN 202011174103.1, filed Oct. 28, 2020.

BACKGROUND OF THE PRESENT INVENTION

Field of Invention

The present application relates to the field of marine outboard cooling technology, and more particularly to a steam-powered outboard conformal cooling system.

Description of Related Arts

At present, the marine outboard cooler is generally arranged at the sea chest. The outboard seawater enters the outboard cooler through the entrance at the bottom of the ship, and then is heated through performing heat exchange with the heat medium in the outboard cooler, and then rises to the exit at the upper portion of the outboard cooler due to the decrease in density for escaping, resulting in the restricted placement of the outboard cooler. Moreover, since the seawater needs to directly exchange heat with the outboard cooler, there is only one grille between the seawater and the outboard cooler, which causes the outboard cooler to be easily blocked by seawater pollutants, so that the heat exchange capacity of the outboard cooler is reduced. As a result, the equipment to be cooled in the cabin is prone to overheating accidents. In addition, the heat exchange between the existing outboard cooler and seawater is achieved by natural convection, so the heat exchange efficiency is low.

SUMMARY OF THE PRESENT INVENTION

The present application aims to solve at least one of technical problems existing in the prior art.

Therefore, the present application proposes a steam-powered outboard conformal cooling system, which is able to make full use of outboard space, so as to make the arrangement of the cooler more flexible, thus improving safety and reliability.

A steam-powered outboard conformal cooling system comprises a steam turbine, a cooler and a conformal heat exchanger, wherein:

the steam turbine is connected with the cooler through a steam pipe;

the conformal heat exchanger comprises a casing, a lower cap located at a bottom of the casing, an upper cap located at a top of the casing, and multiple heat exchange tubes located within the casing, wherein the casing comprises an outer shell plate provided outside a hull plate, the outer shell plate and the hull plate define a seawater heat exchange chamber;

the upper cap has a cooling water intake chamber, the lower cap has a cooling water discharge chamber, a first end of each of the heat exchange tubes is communicated with the cooling water intake chamber, a second end of the each of the heat exchange tubes is communicated with the cooling water discharge chamber, the cooling water intake chamber is communicated with the cooler through a water intake pipe, the cooling water discharge chamber is communicated with the cooler through a water discharge pipe.

Preferably, a seawater entrance is provided on the outer shell plate near the lower cap, a seawater entrance grille is provided at the seawater entrance, a seawater exit is provided on the outer shell plate near the upper cap, a seawater exit grille is provided at the seawater exit.

Preferably, a ship shell is provided at a periphery of the hull plate, the hull plate and the ship shell form an outboard chamber, the conformal heat exchanger is provided within the outboard chamber.

Preferably, a water intake baffle is provided above the seawater entrance, and is provided between the outer shell plate and the ship shell.

Preferably, a fluidic device is provided within the outboard chamber and is corresponding to the seawater exit, the fluidic device is connected with the steam pipe through a steam exhaust pipe.

Preferably, the fluidic device comprises a nozzle, a suction port, a circulation pipe and a diffusion port, wherein the suction port and the diffusion port are connected with two ends of the circulation pipe respectively, the suction port is matched with the seawater exit of the seawater heat exchange chamber, an inlet of the nozzle is connected with the steam exhaust pipe, an outlet of the nozzle is provided within the suction port.

Preferably, the suction port is a conical cylinder with gradually decreasing diameter from a first end to a second end, the first end of the suction port is matched with the seawater exit, the second end of the suction port is connected with the circulation pipe; the diffusion port is a conical cylinder with gradually increasing diameter from a first end to a second end, the first end of the diffusion port is connected with the circulation pipe.

Preferably, a seawater barrier is provided above the diffusion port and is installed on an inner side wall of the ship shell.

Preferably, the lower cap comprises a low cap plate provided on an outer side wall of the hull plate, a bottom portion of the casing of the conformal heat exchanger is connected with the lower cap plate, the lower cap plate and the hull plate form the cooling water discharge chamber; the upper cap comprises an upper cap plate provided on the outer side wall of the hull plate, a top portion of the casing of the conformal heat exchanger is connected with the upper cap plate, the upper cap plate and the hull plate form the cooling water intake chamber.

Preferably, the hull plate is curved, the outer shell plate is curved which is matched with the hull plate, the heat exchange tubes are curved which are matched with the outer shell plate.

The above one or more technical solutions provided by the present application have at least one of technical effects as follows.

The steam-powered outboard conformal cooling system provided by the present application comprises a steam turbine, a cooler and a conformal heat exchanger, wherein the steam turbine is connected with the cooler through a steam pipe; the conformal heat exchanger comprises a casing, a lower cap, an upper cap and multiple heat exchange tubes, wherein the casing comprises an outer shell plate provided outside a hull plate, the outer shell plate and the hull plate define a seawater heat exchange chamber, so as to achieve circulation of the outboard seawater in the seawater heat exchange chamber; a first end of each of the heat exchange tubes is communicated with a cooling water intake chamber of the upper cap, the cooling water intake chamber is communicated with the cooler through a water intake pipe, a second end of the each of the heat exchange tubes is communicated with a cooling water discharge chamber of the lower cap, the cooling water discharge chamber is communicated with the cooler through a water discharge pipe. While working, the cooling water in the cooler enters the cooling water intake chamber through the water intake pipe, and then enters the heat exchange tubes through the cooling water intake chamber, and then is cooled through heat exchange with outboard seawater, and then enters the cooling water discharge chamber, and then returns to the cooler through the water discharge pipe, so as to cool steam exhaust discharged by the steam turbine. At the same time, the outboard seawater enters the seawater heat exchange chamber of the conformal heat exchanger, and then is heated by heat exchange with the cooling water in the heat exchange tubes, and then is discharged from the seawater heat exchange chamber. Therefore, the conformal heat exchanger and the ship shell of the steam-powered conformal cooling system provided by the present application form the conformal structure, so that the outboard seawater is able to flow at a shell side of the conformal heat exchange, the cooling water in the cooler is able to flow at a tube side of the conformal heat exchange, so as to cool the steam exhaust discharged by the steam turbine with the outboard seawater, which not only makes full use of the outboard space for making the arrangement position of the cooler on a hull more flexible, but also improves the safety and reliability of the heat exchange process of the system.

Some of additional aspects and advantages of the present application will be set forth in the following description, and some will be apparent from the following description, or learned by practice of the present application.

IN THE DRAWINGS

Figure 1:
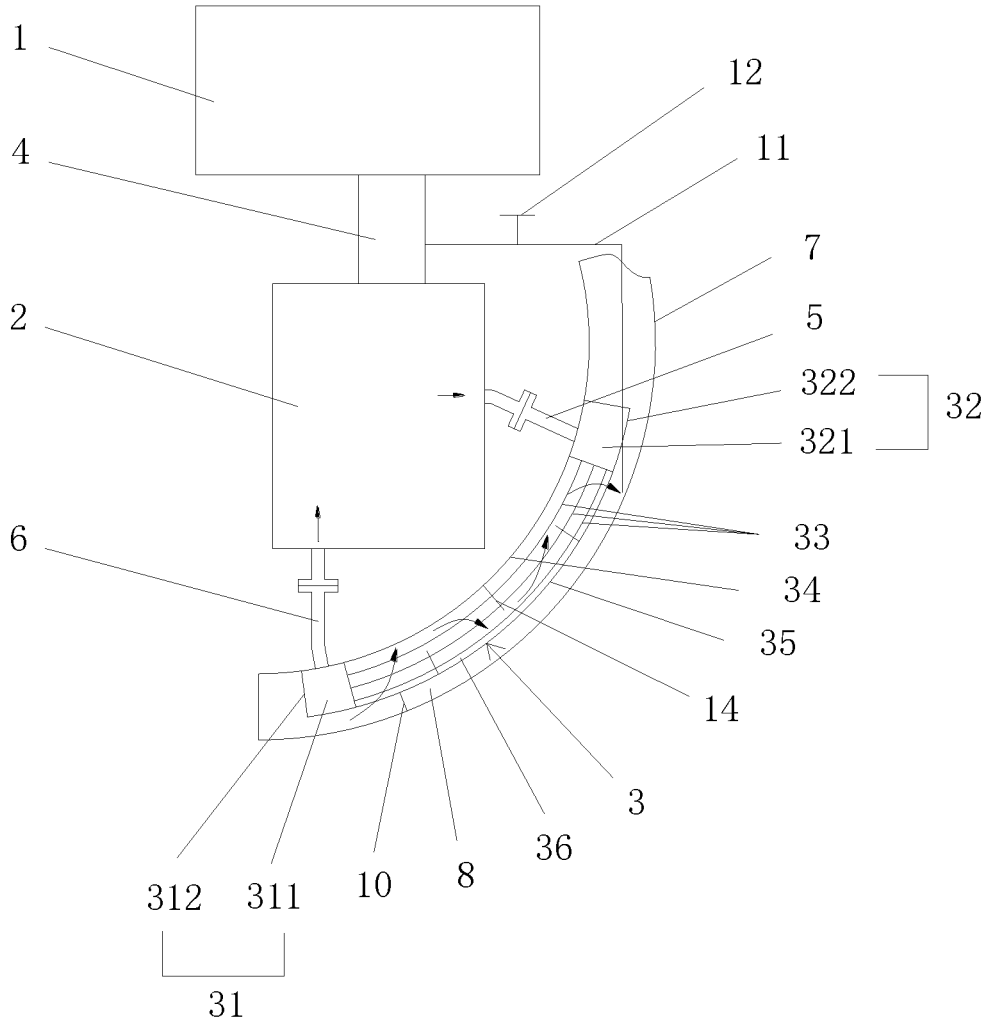
FIG. 1 is a structural schematic diagram of a steam-powered outboard conformal cooling system according to a preferred embodiment of the present application.

1: steam turbine; 2: cooler;

3: conformal heat exchanger; 31: lower cap; 311: cooling water discharge chamber; 312: lower cap plate; 32: upper cap; 321: cooling water intake chamber; 322: upper cap plate; 33: heat exchange tube; 34: hull plate; 35: outer shell plate; 351: seawater entrance grille; 352: seawater exit grille; 36: seawater heat exchange chamber;

4: steam pipe; 5: water intake pipe; 6: water discharge pipe; 7: ship shell; 8: outboard chamber;

9: fluidic device; 91: nozzle; 92: suction port; 93: circulation pipe; 94: diffusion port;

10: water intake baffle; 11: steam exhaust pipe; 12: steam exhaust control valve; 13: seawater barrier; 14: baffle plate.

DETAILED DESCRIPTION OF THE PREFERRED EMBODIMENT

The present application will be further described in detail with reference to the accompanying drawings and embodiments as follows. The following embodiments are used to illustrate the present application, but not to limit the protection scope of the present application.

In the description of the preferred embodiments of the present application, it should be understood that the terms "central", "longitudinal", "transverse", "upper", "lower", "front", "rear", "left", "right", "vertical", "horizontal", "top", "bottom", "inside", "outside" and other indicated orientations or positional relationships are based on the orientations or positional relationships shown in the drawings, which is only for the convenience of describing the present application and simplifying the description, rather than indicating or implying that the device or component referred to must have a particular orientation, must be constructed and operated in a particular orientation, and therefore these terms should not be construed as a limitation of the present application. In addition, the terms "first", "second", "third" etc. are only used for descriptive purposes, and should not be understood as indicating or implying relative importance.

In the description of the preferred embodiments of the present application, it should be noted that unless otherwise expressly specified and limited, the terms "connection" and "connected" should be understood in a broad sense, for example, it may be a fixed connection, a detachable connection, or an integral connection; it also may be a mechanical connection or an electrical connection; it also may be a direct connection, an indirect connection through an intermediate medium. For those skilled in the art, the specific meanings of the above terms in the present application are able to be understood through specific situations.

In the embodiments of the present application, unless otherwise expressly specified and limited, the description that the first feature is provided "on" or "under" the second feature is the direct contact between the first feature and the second features. Also, the description that the first feature is provided "above" and "over" the second feature may mean that the first feature is higher than the second feature. The description that the first feature is provided "below" and "over" the second feature may mean that the first feature is lower than the second feature.

In the description of this specification, the terms, such as "one embodiment," "some embodiments," "example," "specific example," and "some examples", mean specific features, structures, or materials described in connection with the embodiments or examples are included in at least one example or embodiment of the present application. In this specification, schematic representations of the above terms are not necessarily directed to the same embodiment or example. Moreover, the particular features, structures or materials described may be combined in any suitable manner in any one or more embodiments or examples. Furthermore, those skilled in the art may combine different embodiments or examples described in this specification, as well as features of different embodiments or examples, without contradicting each other.

Figure 2:
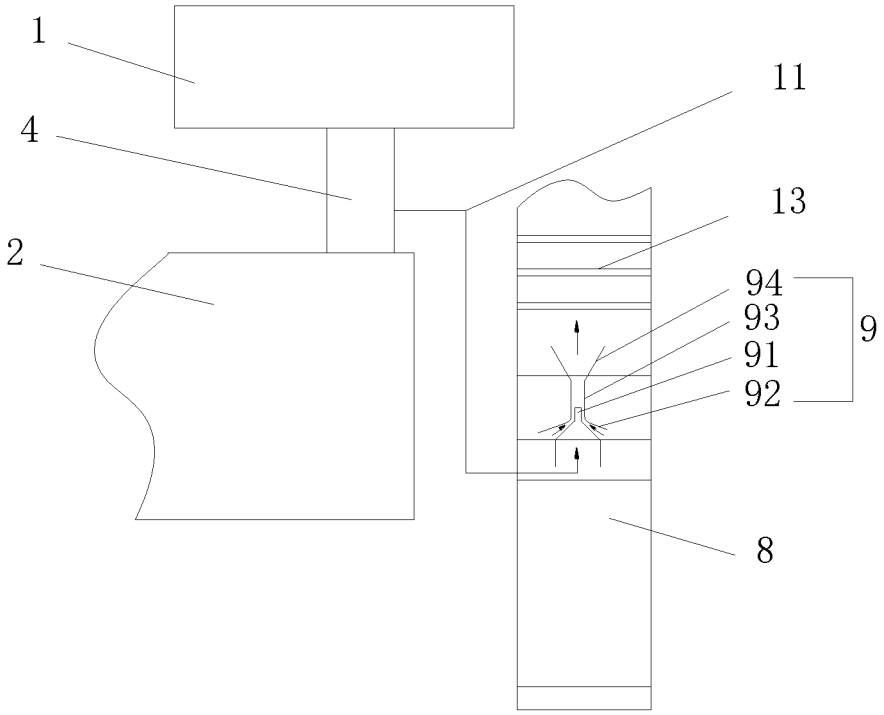
FIG. 2 is a structural schematic diagram of a fluidic device of the cooling system according to the above preferred embodiment of the present application.
Figure 3:
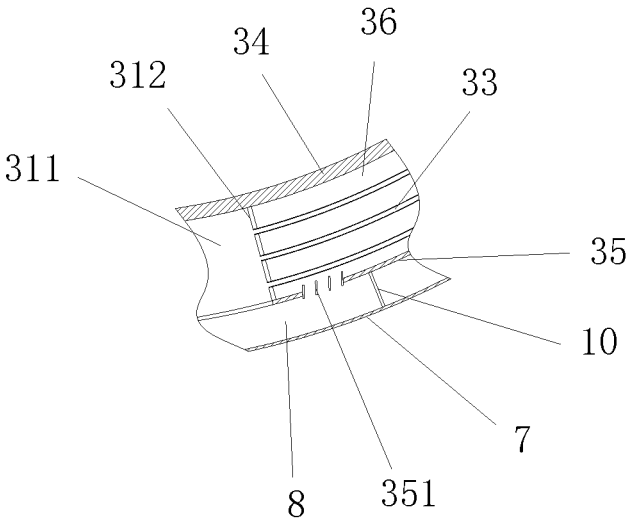
FIG. 3 is a structural schematic diagram of a seawater entrance grille of the cooling system according to the above preferred embodiment of the present application.
Figure 4:
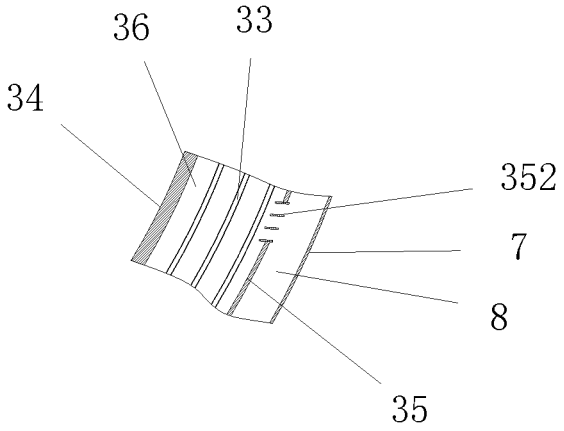
FIG. 4 is a structural schematic diagram of a seawater exit grille of the cooling system according to the above preferred embodiment of the present application.

Referring to FIGS. 1 to 4, a steam-powered outboard conformal cooling system according to a preferred embodiment of the present application is illustrated, in which the direction of the arrow in the drawings indicates the flow direction of the liquid. The steam-powered outboard conformal cooling system comprises a steam turbine 1, a cooler 2 and a conformal heat exchanger 3, wherein the steam turbine 1 is connected with the cooler 2 through a steam pipe 4, that is, the steam exhaust discharged from the steam turbine 1 is transmitted to the cooler 2 through the steam pipe 4 for heat exchange with cooling water in the cooler 2, so as to cool the steam exhaust.

The conformal heat exchanger 3 comprises a casing, a lower cap 31 located at a bottom of the casing, an upper cap 32 located at a top of the casing, and multiple heat exchange tubes 33 located within the casing, wherein the casing comprises an outer shell plate 35 provided outside a hull plate 34, the outer shell plate 35 and the hull plate 34 define a seawater heat exchange chamber 36, that is, a part of the hull plate 34 is used as an inner shell plate of the conformal heat exchanger 3 to cooperate with the outer shell plate 35 to form a conformal structure.

The upper cap 32 has a cooling water intake chamber 321, the lower cap 31 has a cooling water discharge chamber 311, a first end of each of the heat exchange tubes 33 is communicated with the cooling water intake chamber 321, a second end of the each of the heat exchange tubes 33 is communicated with the cooling water discharge chamber 311. The cooling water intake chamber 321 is communicated with a cooling water outlet of the cooler 2 through a water intake pipe 5, the cooling water discharge chamber 311 is communicated with a cooling water inlet of the cooler 2 through a water discharge pipe 6.

While working, the cooling water in the cooler 2 enters the cooling water intake chamber 321 of the upper cap 32 through the water intake pipe 5, and then enters the heat exchange tubes 33 through the cooling water intake chamber 321, and then is cooled through heat exchange with outboard seawater, and then enters the cooling water discharge chamber 311 of the lower cap 31, and then returns to the cooler 2 through the water discharge pipe 6, so as to cool steam exhaust discharged by the steam turbine 1. At the same time, the outboard seawater enters the seawater heat exchange chamber 36 of the conformal heat exchanger 3, and then is heated by heat exchange with the cooling water in the heat exchange tubes 33, and then is discharged from the seawater heat exchange chamber 36.

Therefore, the conformal heat exchanger 3 and the hull plate 34 of the steam-powered conformal cooling system provided by the present application form the conformal structure, so that the outboard seawater is able to flow at a shell side of the conformal heat exchange 3, the cooling water in the cooler 2 is able to flow at a tube side of the conformal heat exchange 3, so as to cool the steam exhaust discharged by the steam turbine 1 with the outboard seawater, which not only makes full use of the outboard space for making the arrangement position of the cooler 2 on a hull more flexible, but also improves the safety and reliability of the heat exchange process of the system.

Specifically, the hull plate 34 is curved, the outer shell plate 35 is curved which is matched with the hull plate 34, the heat exchange tubes 33 are curved which are matched with the outer shell plate 35, that is, the heat exchange tubes 33 are curved from bottom to top.

Specifically, a ship shell 7 is provided at a periphery of the hull plate 34, the hull plate 34 and the ship shell 7 form an outboard chamber 8, the conformal heat exchanger 3 is provided within the outboard chamber 8, that is, the conformal heat exchanger 3 is provided within the outboard chamber 8 which is defined by the hull plate 34 and the ship shell 7, which is able to effectively protect the conformal heat exchanger 3 for further improving the safety and reliability of the heat exchange process of the system.

Preferably, a seawater entrance is provided on the outer shell plate 35 near the lower cap 31, the seawater entrance is communicated with the seawater heat exchange chamber 36, a seawater entrance grille 351 is provided at the seawater entrance and has an angle of inclination for introducing the outboard seawater into the seawater heat exchange chamber 36. A seawater exit is provided on the outer shell plate 35 near the upper cap 32, the seawater exit is communicated with the seawater heat exchange chamber 36, a seawater exit grille 352 is provided at the seawater exit and has an angle of inclination for leading the outboard seawater out of the seawater heat exchange chamber 36. The outboard seawater enters the seawater heat exchange chamber 36 of the conformal heat exchanger 3 through the seawater entrance, and then is heated through heat exchange with the cooling water in the heat exchange tubes 33, and then is discharged out of the seawater heat exchange chamber 36 through the seawater exit. The seawater entrance grille 351 and the seawater exit grille 352 are able to protect the conformal heat exchanger 3 to effectively prevent pollutants from entering the seawater heat exchange chamber 36, so as to prevent the seawater heat exchange chamber 36 from being blocked by the pollutants, thereby further improving the safety and reliability of the system.

Since the seawater entrance is provided at a lower portion of the outer shell plate 35, the seawater exit is provided at an upper portion of the outer shell plate 35, the outboard seawater flows into the seawater heat exchange chamber 36 from a lower portion thereof and flows out of the seawater heat exchange chamber 36 from an upper portion thereof.

Preferably, a water intake baffle 10 is provided above the seawater entrance, and is provided between the outer shell plate 35 and the ship shell 7. The water intake baffle 10 cooperates with the seawater entrance grille 351 for facilitating introducing the outboard seawater into the seawater heat exchange chamber 36.

Preferably, a fluidic device 9 is provided within the outboard chamber 8 and is corresponding to the seawater exit. The fluidic device 9 is connected with the steam pipe 4 through a steam exhaust pipe 11. A steam exhaust control valve 12 is provided on the steam exhaust pipe 11 for controlling the circulation status of the steam exhaust in the steam exhaust pipe 11. The fluidic device 9 takes the steam exhaust discharged by the steam turbine 1 as the working fluid, sucks the seawater which flows out of the conformal heat exchanger 3 through the seawater exit and then discharges the seawater in an ejection manner. Therefore, the steam exhaust discharged from the steam turbine 1 is rationally utilized to realize the forced convection heat exchange between the conformal heat exchanger 3 and the outboard seawater, thereby improving the heat exchange efficiency of the system.

Specifically, the fluidic device 9 comprises a nozzle 91, a suction port 92, a circulation pipe 93 and a diffusion port 94, wherein the suction port 92 and the diffusion port 94 are connected with two ends of the circulation pipe 93 respectively, the suction port 92 is matched with the seawater exit of the seawater heat exchange chamber 36, an inlet of the nozzle 91 is connected with the steam exhaust pipe 11, an outlet of the nozzle 91 is provided within the suction port 92. The working fluid of the fluidic device 9 is the steam exhaust from the steam pipe 4, the sucked fluid is the heated outboard seawater which flows from the seawater exit of the seawater heat exchange chamber 36, the temperature of the steam exhaust from the steam pipe 4 is about 50° C. After condensing into liquid water, the steam exhaust shrinks sharply in volume, so that a negative pressure area is formed at the outlet of the nozzle 91, and the outboard seawater flowing from the seawater exit is introduced into the suction port 92, and then under the action of turbulent diffusion, the outboard seawater introduced from the suction port 92 is mixed with the steam exhaust ejected from the nozzle 91 and then is ejected outside the fluidic device 9 through the diffusion port 94, so as to improve the water discharge speed of the seawater exit of the seawater heat exchange chamber 36, so that the flow speed of the outboard seawater which passes through the seawater heat exchange chamber 36 is improved, thereby achieving the forced convection heat exchange between the conformal heat exchanger 3 and the outboard seawater. At the same time, the outboard seawater flowing out of the fluidic device 9 is also heated to a certain extent, so that the upward flow speed of the outboard seawater is increased due to the decrease in density.

Specifically, the suction port 92 is a conical cylinder with gradually decreasing diameter from a first end to a second end, the first end of the suction port 92 is matched with the seawater exit, the second end of the suction port 92 is connected with the circulation pipe 93. This structure of the suction port 92 facilitates the introduction of the outboard seawater from the seawater exit into an interior of the suction port 92.

Specifically, the diffusion port 94 is a conical cylinder with gradually increasing diameter from a first end to a second end, the first end of the diffusion port 94 is connected with the circulation pipe 93, the second end of the diffusion port 94 has an inverted cone structure. This structure of the diffusion port 94 facilitates the discharge of the outboard seawater mixed with the steam exhaust which is ejected from the nozzle 91.

Specifically, the fluidic device 9 is installed on an inner side wall of the ship shell 7 through a mounting bracket, so as to realize the installation and fixation of the fluidic device 9 inside the outboard chamber 8.

Preferably, a seawater barrier 13 is provided above the diffusion port 94 and is installed on the inner side wall of the ship shell 7, so as to facilitate the final discharge of the outboard seawater from the fluidic device 9 to the sea.

Preferably, multiple baffle plates 14 are provided within the casing of the conformal heat exchanger 3 and are arranged at staggered intervals along a lengthwise extending direction of the heat exchange tubes 33, which is beneficial to guide the flow of outboard seawater inside the seawater heat exchange chamber 36.

Preferably, the upper cap 32 comprises an upper cap plate 322 provided on an outer side wall of the hull plate 34, a top portion of the casing of the conformal heat exchanger 3 is connected with the upper cap plate 322, the upper cap plate 322 and the hull plate 34 form the cooling water intake chamber 321, the cooling water intake chamber 321 is separate from the seawater heat exchange chamber 36, the first end of the each of the heat exchange tubes 33 passes through the upper cap plate 322 and is communicated with the cooling water intake chamber 321.

Preferably, the lower cap 31 comprises a low cap plate 312 provided on the outer side wall of the hull plate 34, a bottom portion of the casing of the conformal heat exchanger 3 is connected with the lower cap plate 312, the lower cap plate 312 and the hull plate 34 form the cooling water discharge chamber 311, the cooling water discharge chamber 311 is separate from the seawater heat exchange chamber 36, the second end of the each of the heat exchange tubes 33 passes through the lower cap plate 312 and is communicated with the cooling water discharge chamber 311.

The above embodiments are only used to illustrate the present application, but not to limit the present application. Although the present application has been described in detail with reference to the embodiments, those skilled in the art should understand that various combinations, modifications or equivalent replacements are made to the technical solutions of the present application without departing from the spirit and scope of the technical solutions of the present application, and should be included in the protective scope of the claims of the present application.

What is claimed is:

1. A steam-powered outboard conformal cooling system, comprising a steam turbine, a cooler and a conformal heat exchanger, wherein:

the steam turbine is connected with the cooler through a steam pipe;

the conformal heat exchanger comprises a casing, a lower cap located at a bottom of the casing, an upper cap located at a top of the casing, and multiple heat exchange tubes located within the casing, wherein the casing comprises an outer shell plate provided outside a hull plate, the outer shell plate and the hull plate define a seawater heat exchange chamber;

the upper cap has a cooling water intake chamber, the lower cap has a cooling water discharge chamber, a first end of each of the heat exchange tubes is communicated with the cooling water intake chamber, a second end of the each of the heat exchange tubes is communicated with the cooling water discharge chamber, the cooling water intake chamber is communicated with the cooler through a water intake pipe, the cooling water discharge chamber is communicated with the cooler through a water discharge pipe;

a seawater entrance is provided on the outer shell plate near the lower cap, a seawater entrance grille is provided at the seawater entrance, a seawater exit is provided on the outer shell plate near the upper cap, a seawater exit grille is provided at the seawater exit.

2. The steam-powered outboard conformal cooling system according to claim 1, wherein a ship shell is provided at a periphery of the hull plate, the hull plate and the ship shell form an outboard chamber, the conformal heat exchanger is provided within the outboard chamber.

3. The steam-powered outboard conformal cooling system according to claim 2, wherein a water intake baffle is provided above the seawater entrance, and is provided between the outer shell plate and the ship shell.

4. The steam-powered outboard conformal cooling system according to claim 2, wherein a fluidic device is provided within the outboard chamber and is corresponding to the seawater exit, the fluidic device is connected with the steam pipe through a steam exhaust pipe.

5. The steam-powered outboard conformal cooling system according to claim 4, wherein the fluidic device comprises a nozzle, a suction port, a circulation pipe and a diffusion port, wherein the suction port and the diffusion port are connected with two ends of the circulation pipe respectively, the suction port is matched with the seawater exit of the seawater heat exchange chamber, an inlet of the nozzle is connected with the steam exhaust pipe, an outlet of the nozzle is provided within the suction port.

6. The steam-powered outboard conformal cooling system according to claim 5, wherein the suction port is a conical cylinder with gradually decreasing diameter from a first end of the suction port to a second end of the suction port, the first end of the suction port is matched with the seawater exit, the second end of the suction port is connected with the circulation pipe; the diffusion port is a conical cylinder with gradually increasing diameter from a first end of the diffusion port to a second end of the diffusion port, the first end of the diffusion port is connected with the circulation pipe.

7. The steam-powered outboard conformal cooling system according to claim 6, wherein a seawater barrier is provided above the diffusion port and is installed on an inner side wall of the ship shell.

8. The steam-powered outboard conformal cooling system according to claim 1, wherein the lower cap comprises a low cap plate provided on an outer side wall of the hull plate, a bottom portion of the casing of the conformal heat exchanger is connected with the lower cap plate, the lower cap plate and the hull plate form the cooling water discharge chamber; the upper cap comprises an upper cap plate provided on the outer side wall of the hull plate, a top portion of the casing of the conformal heat exchanger is connected with the upper cap plate, the upper cap plate and the hull plate form the cooling water intake chamber.

9. The steam-powered outboard conformal cooling system according to claim 2, wherein the lower cap comprises a low cap plate provided on an outer side wall of the hull plate, a bottom portion of the casing of the conformal heat exchanger is connected with the lower cap plate, the lower cap plate and the hull plate form the cooling water discharge chamber; the upper cap comprises an upper cap plate provided on the outer side wall of the hull plate, a top portion of the casing of the conformal heat exchanger is connected with the upper cap plate, the upper cap plate and the hull plate form the cooling water intake chamber.

10. The steam-powered outboard conformal cooling system according to claim 3, wherein the lower cap comprises a low cap plate provided on an outer side wall of the hull plate, a bottom portion of the casing of the conformal heat exchanger is connected with the lower cap plate, the lower cap plate and the hull plate form the cooling water discharge chamber; the upper cap comprises an upper cap plate provided on the outer side wall of the hull plate, a top portion of the casing of the conformal heat exchanger is connected with the upper cap plate, the upper cap plate and the hull plate form the cooling water intake chamber.

11. The steam-powered outboard conformal cooling system according to claim 4, wherein the lower cap comprises a low cap plate provided on an outer side wall of the hull plate, a bottom portion of the casing of the conformal heat exchanger is connected with the lower cap plate, the lower cap plate and the hull plate form the cooling water discharge chamber; the upper cap comprises an upper cap plate provided on the outer side wall of the hull plate, a top portion of the casing of the conformal heat exchanger is connected with the upper cap plate, the upper cap plate and the hull plate form the cooling water intake chamber.

12. The steam-powered outboard conformal cooling system according to claim 5, wherein the lower cap comprises a low cap plate provided on an outer side wall of the hull plate, a bottom portion of the casing of the conformal heat exchanger is connected with the lower cap plate, the lower cap plate and the hull plate form the cooling water discharge chamber; the upper cap comprises an upper cap plate provided on the outer side wall of the hull plate, a top portion of the casing of the conformal heat exchanger is connected with the upper cap plate, the upper cap plate and the hull plate form the cooling water intake chamber.

13. The steam-powered outboard conformal cooling system according to claim 6, wherein the lower cap comprises a low cap plate provided on an outer side wall of the hull plate, a bottom portion of the casing of the conformal heat exchanger is connected with the lower cap plate, the lower cap plate and the hull plate form the cooling water discharge chamber; the upper cap comprises an upper cap plate provided on the outer side wall of the hull plate, a top portion of the casing of the conformal heat exchanger is connected with the upper cap plate, the upper cap plate and the hull plate form the cooling water intake chamber.

14. The steam-powered outboard conformal cooling system according to claim 7, wherein the lower cap comprises a low cap plate provided on an outer side wall of the hull plate, a bottom portion of the casing of the conformal heat exchanger is connected with the lower cap plate, the lower cap plate and the hull plate form the cooling water discharge chamber; the upper cap comprises an upper cap plate provided on the outer side wall of the hull plate, a top portion of the casing of the conformal heat exchanger is connected with the upper cap plate, the upper cap plate and the hull plate form the cooling water intake chamber.

15. The steam-powered outboard conformal cooling system according to claim 1, wherein the hull plate is curved, the outer shell plate is curved which is matched with the hull plate, the heat exchange tubes are curved which are matched with the outer shell plate.

16. The steam-powered outboard conformal cooling system according to claim 7, wherein the hull plate is curved, the outer shell plate is curved which is matched with the hull plate, the heat exchange tubes are curved which are matched with the outer shell plate.

17. The steam-powered outboard conformal cooling system according to claim 13, wherein the hull plate is curved, the outer shell plate is curved which is matched with the hull plate, the heat exchange tubes are curved which are matched with the outer shell plate.

18. The steam-powered outboard conformal cooling system according to claim 14, wherein the hull plate is curved, the outer shell plate is curved which is matched with the hull plate, the heat exchange tubes are curved which are matched with the outer shell plate.

* * * * *